US005810279A

United States Patent [19]

Rodriguez et al.

[11] Patent Number: 5,810,279

[45] Date of Patent: Sep. 22, 1998

[54] SYSTEM AND METHOD FOR SEVERING AND SPOOLING A WEB

[75] Inventors: Peter A. Rodriguez, Jacksonville; Thomas B. Middlebrooks, Hastings, both of Fla.

[73] Assignee: Sandar Industries, Inc., Jacksonville, Fla.

[21] Appl. No.: 868,502

[22] Filed: Jun. 4, 1997

[51] Int. Cl.[6] ..... B65H 35/10; B65H 19/28

[52] U.S. Cl. ..... 242/521; 242/532.3; 156/185; 156/522

[58] Field of Search ..... 242/521, 522, 242/523, 523.1, 524, 532.1, 532.3; 156/185, 187, 522

[56] References Cited

U.S. PATENT DOCUMENTS

| | | | |
|---|---|---|---|
| 2,980,356 | 4/1961 | Beese et al. | 242/523.1 |
| 3,365,992 | 1/1968 | Dreher | 242/532.3 |
| 3,782,664 | 1/1974 | Alberto | 242/532.1 |
| 3,997,387 | 12/1976 | Yamaguchi et al. | 242/523.1 |
| 4,458,852 | 7/1984 | Calvert et al. | 242/524 |
| 4,659,029 | 4/1987 | Rodriguez | 83/636 |
| 5,346,150 | 9/1994 | Volin | 242/527.1 |
| 5,346,151 | 9/1994 | Zimmerman et al. | 242/521 |
| 5,377,930 | 1/1995 | Noyes | 242/521 |
| 5,379,962 | 1/1995 | Albrecht et al. | 242/527.7 |
| 5,441,211 | 8/1995 | Ueda et al. | 242/532.3 |
| 5,453,141 | 9/1995 | Rodriguez | 242/521 |
| 5,632,849 | 5/1997 | Ogren et al. | 156/446 |
| 5,637,170 | 6/1997 | Rodriguez | 242/521 |

FOREIGN PATENT DOCUMENTS

| | | | |
|---|---|---|---|
| 4-223956 | 8/1992 | Japan | 242/532.3 |

*Primary Examiner*—John P. Darling
*Attorney, Agent, or Firm*—Arthur G. Yeager

[57] ABSTRACT

A severing and spool assembly employs various weakening devices and techniques to provide a shear force along a narrow elongate portion of the web. One method involves scoring a paper web being spooled in a manner to provide for a controlled tearing along the scored web across its width. A portion of the web adjacent the origin of the score is attached to a take up spool using an adhesive flag member. The change in direction of the spool from roughly horizontal to nearly vertical places forces on the web sufficient to cause web tearing in a manner substantially following the score. High pressure air may be used to assist the vertical turn up action of the paper onto an empty spool.

Other methods of creating the shear force portion or line include the use of lasers to weaken the paper and applying a thin layer and line of adhesive to the surface of the web such that the web attaches to the spool along the line and the creation of two score lines that may converge at the center of the web or be staggered in the case of very wide webs.

26 Claims, 8 Drawing Sheets

SYSTEM AND METHOD FOR SEVERING AND SPOOLING A WEB

BACKGROUND OF THE INVENTION

1. Field of the Invention

The present invention relates to an improvement in apparatus for severing and spooling a traveling web or sheet of paper in the paper making or other converting industry.

1. Prior Art

It is common practice in the paper industry to wind a continuous sheet or web of paper onto a rotating spool and then to cut the sheet and begin winding the paper onto another spool. Modern technology requires the cutting and spooling to be done in the shortest possible time that is reliable, economical, and safe for the reason that paper-making technology provides a continuous sheet of paper. An example of one technique used for cutting and spooling is described in U.S. Pat. No. 4,659,029. Improved techniques are disclosed herein.

There is a need for improved cutting and spooling methods and apparatus over the prior art.

SUMMARY OF THE INVENTION

In one aspect of the present invention there is provided a method of transferring a web of thin material from a first spool to a second spool including the steps of: providing an elongate portion of the web to which shear force can be applied beginning adjacent one edge of the web to define a start portion and extending substantially across the width of the web to adjacent the opposite edge; affixing the start portion of the web to the second spool; and winding the web onto the second spool in a manner to provide shear force along the elongate portion formed in step A to cause severing of the web generally along the elongate portion to sever the web entirely between its edges.

The present invention also includes the steps of: applying a layer of pressure-sensitive adhesive to the web along the elongate portion for attaching the web to the second spool with the adhesive layer; applying an initial portion of the layer of adhesive in a direction substantially parallel to the one edge of the web; applying a water soluble glue to structurally weaken the web along the elongate portion; providing the elongate portion to extend from the start portion to the opposite edge of the web; and structurally weakening the web along a narrow line starting from adjacent one edge and extending substantially across the web.

Other aspects of the invention include the steps of: employing a movable weakening means to provide a single substantially continuous line across the web; scoring the web with a sharp element; scoring the web with a sharp element from one planar side with an anvil on the other planar side; employing a movable scoring means to provide a single substantially continuous scoring of the web; and affixing one portion of an adhesive tape to the start portion of the web and another portion of the tape to the second spool.

The methods also include the steps of: scoring the web with a sharp element to structurally weaken the web along the elongate portion; spraying a thin stream of water onto the web to structurally weaken the web along the elongate portion; spraying a thin stream of air and particulate at the web to structurally weaken the web along the elongate portion; applying a narrow and thin layer of adhesive to the web to attach the web to the second spool along the elongate portion; applying water soluble adhesive to structurally weaken the web along the elongate portion; passing a laser beam capable of structurally weakening the web across the web to weaken the web along the elongate portion; moving the laser emitting the laser beam across the web; and moving the laser beam across the web without traversing the web with the laser.

In further aspects, the weakening or scoring may be from both edges of the web toward the middle, or may be provided sequentially from one edge to the middle and another from the middle to the other edge. The weakening may be chemically by a fluid application roller on one planar web surface with an anvil on the other planar web surface.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT INTRODUCTION

Figure 1:
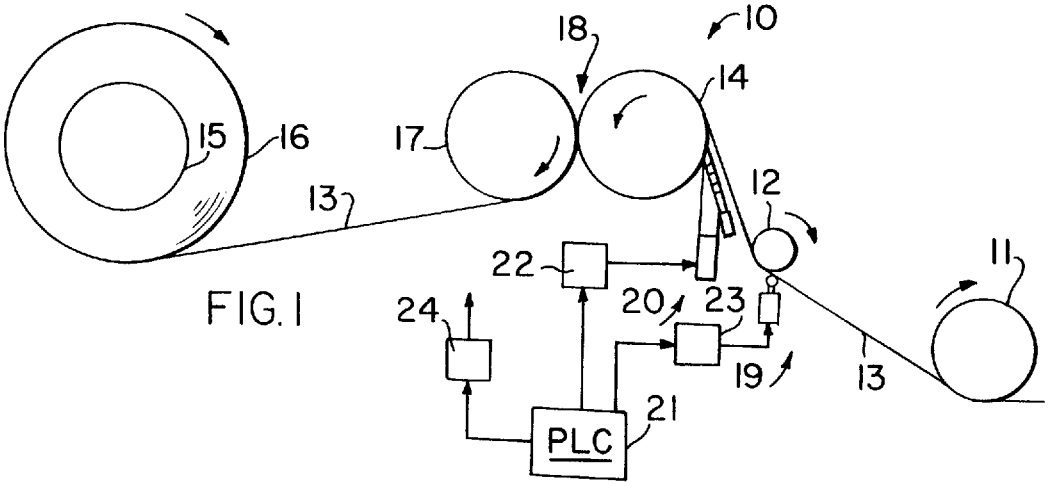
FIG. 1 is a side elevation pictorial diagram of the spools and web of a paper process illustrating the relative position of the weakening and attachment apparatus according to the present invention.

A brief review of the spooling and turn-up process and layout will assist in illustrating the present invention. A series of rollers are used to guide the web of paper onto a drum roller and from there the web is directed to a take-up spool where it is wound and collected. The principal objective of the present invention is an improved way to redirect the web to an empty spool when the take-up spool is full.

The contact between the drum roller and the empty spool is called a nip. The transfer of the web from the full spool to the empty spool is usually accomplished by cutting the web and winding it onto the empty spool. The present invention is directed towards an improved process to treat the web with a weakened line, as by scoring, or with adhesive along a transverse line and the winding of the web onto the empty spool via an adhesive flag applied to the web to initiate a tear to create a shear force line on the web at which line the web will be severed.

The following is a brief description of the method and apparatus according to the present invention for cutting, attaching and spooling a web of media at a wide range of machine speeds. This method is ideally suited for high quality paper media such as coating grades.

This method, which is a controlled tear method, will provide a weakening process for turn-up that does not use a traveling device of the prior art as a cutting means. This method uses a combination of the following operations controlled by Programmable Logic Controller (PLC):

1) Introduction of one or more flags to facilitate a tear(s);
2) Controlled tear propagation facilitated by mechanical weakening of the web prior to flag introduction;
3) Vectored high pressure air jets to aid proper wrapping of new spool.

A flag is introduced into the web before the nip formed between the spool and drum. The flag has the following properties:

1) Highly tear resistant base material such as acetate or tear-resistant paper;
2) A base geometry defined by the type and shape of the desired tear in the web; and
3) a. Base coated on one side with two levels (thicknesses) of pressure sensitive adhesive or a single thickness of compressible adhesive; or
3) b. Multilevel thicknesses of the flag material coupled with single or multilevel thicknesses of adhesive.

The flag is introduced to the web prior to or at the leading side of the drum. Introduction is accomplished by pushing the leading edge of the flag into the web as it begins to wind around the drum. The flag may have two different thicknesses of adhesive. On the inner portion of the flag (designed to attach to the media web) the adhesive is of a thickness appropriate to achieve the proper attachment. On the outer portion of the flag (designed to attach to the new spool) the adhesive is of a thickness greater than the inner side thickness plus the thickness of the media web. The flag will attach itself to the web from the pressure formed between the drum and the web. Prior to introduction, the flag is housed in a specially designed tray dispenser. At the desired time the flag will be pushed out of the tray and into the web/drum interface.

After introduction, the flag will travel around the drum approaching the nip. Upon reaching the nip, the flag will attach itself to the new spool via the adhesive on the face of the flag outside of the web coverage. At this time shear force will come into play between angular edge of the flag and the web. The web will begin to tear in an angle dictated by the geometry of the flag. Controlled tear propagation is facilitated by weakening the web along an angular shear force line leading from the start of a single tear that travels across the web or from the start of a pair of tears that travel toward the center of the web.

Weakening of the web can be performed by one or more methods such as the following:

1) Traversing the web with a needle-type element;
2) Traversing the web with a thermal device such as a resistance probe or laser; and
3) Traversing the web with a fluid nozzle to inject water, air or suspended particulate.

The web may be traversed and weakened prior to the time of flag introduction. This can be facilitated by mounting a shuttle containing one (or more) of the aforementioned methods on one (or more) of the following prime moving methods:

1) Air cylinder;
2) Linear track bearing (with a motive force such as air ram);
3) Belt train;
4) Electrical linear accelerator; and
5) Lead screw mechanism.

Positioning of the traversing shuttle(s) is done before the flag introduction tray(s) and can take place (depending upon method) in a span between rollers or on the top or bottom of a roller, with the roller emulating a dynamic anvil. Timing coordination between the web weakening process and the introduction of the flag is critical. By holding the weakening device shuttle static momentarily upon the start of weakening, a propagation start line running in a direction along the flow of media is formed. This line provides a window in time (and thus media flow) that the flag can be introduced. This time can be adjusted through the PLC. Upon the formation of a start line of correct length the shuttle traverses the web providing a weakened curvilinear path for tear propagation. It must be noted that the shuttle movement does not wait for the introduction of the flag to begin traversal of the web. Timing of the start line formation, tear propagation line formation and the introduction of the flag is completely adjustable through the PLC and will be set depending upon installation geometry and paper machine dynamics.

Vectored release of compressed air can be used to aid the wrap of the new spool. With proper placement of air nozzles between the new spool and full reel and proper timing of their use the torn media can be further directed to wrap the new spool. Timing of the vectored air can be controlled via pneumatic valves operated by the PLC.

The following configuration is preferred:

1) Adhesive flag, based with acetate;
2) Single flag dispenser;
3) Web weakening from adjacent one end;
4) Use of vectored air between new spool and full reel to aid turn up. All functions are controlled with a PLC and electrically controlled pneumatic valves.

The adhesive flag is held in a flag tray dispenser. The flag is held in orientation by a tray mounted at a prescribed angle determined by web orientation. The flag tray is moved under the web (for use) and out from under the web (for loading) by means of a carriage mounted on a linear track with motive force provided by a rodless air cylinder. The flag is inserted into the nip by movement of a flag feed slide controlled by a double action air cylinder.

In order to weaken the web and promote controlled tear propagation, a needle type element is traversed longitudinally across the moving web to produce a propagation line. The web traversal is accomplished by mounting a shuttle holding a web weakening device on a linear bearing track and using a rodless air cylinder as a motivating force. A non-rotating double action air cylinder is mounted atop the shuttle on the traversal centerline to raise, lower and dampen the movement of a wear-resistant sphere mounted on top. The sphere is raised to a point such that it applies a predescribed force upon the bottom of the web during shuttle traversal. A hardened needle which may employ a diamond tip is mounted in a slot bored in the sphere. The needle protrudes from the sphere a set amount to facilitate a score of the web upon traversal. The needle is held in place with a set screw oriented at an angle to the needle mounting.

The cycle for weakening the web is controlled by PLC and is as follows:

(1) Apply prescribed pressure to double-action air cylinder to raise sphere and begin scoring start line approximately 60% of the width of the flag from the edge of the web;

(2) At the proper time apply prescribed pressure to rodless air cylinder to accelerate carriage to traverse web;

(3) Upon reaching the end of traversal remove pressure from rodless air cylinder and double-action cylinder. At the end-of-track, a sensor, such as a Hall effect device, can be used to provide for proper PLC input. Shuttle velocity can be dampened at the end of track by reverse pressure and/or dampening;

(4) Pressure is then applied to the far side of the rodless shuttle to bring the shuttle back to home position for the next turn-up.

THE PRESENT SYSTEM AND METHOD

With respect now to the drawings, a web turn-up process that employs the present invention is illustrated at numeral 10 in FIG. 1. Rollers 11 and 12 guide web 13 to drum roller 14 and onto take-up spool 15 where the paper 16 is collected. The web 13 is transferred to empty spool 17 after the web is severed and bound to the spool 17 through nip 18 via weakening apparatus shown generally at 19 and adhesive is applied by web attachment apparatus shown generally at 20.

Programmable logic controller 21 is a computer-based process controller that controls electric power and air that is supplied to electro-pneumatic actuator valve means 22, 23 associated with the respective flag apparatus 20, weakening apparatus 19, and other devices employed in the system. Vectored air via actuator 24 can be supplied after nip 18 onto spool 17 in a manner coordinated with the weakening and attachment apparatus 19, 20 if desired in the circumstances to assist in the movement and the attachment of the web 13 onto the new spool 17.

Figure 2:
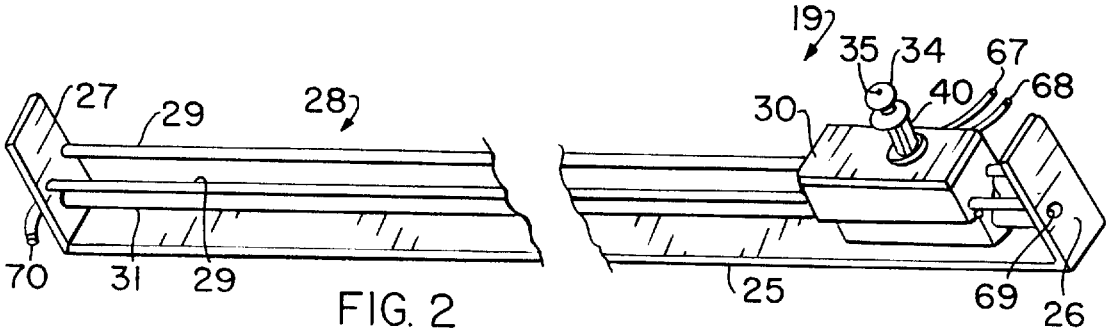
FIG. 2 is a perspective view of one of the weakening apparatus of FIG. 1.

FIG. 2 illustrates a pictorial of the weakening apparatus 19. A frame 25 with upright end members 26 and 27 support linear track 28 of two elongate cylindrical guides or rails 29. Guides 29 support linear bearing carrier 30 which is a component of the air-operated rodless cylinder 31.

The rodless cylinders employed in the present invention may be the "Ultran Slide" brand or "Ultra" brand of rodless cylinder made by the Bimba Manufacturing Company. The Ultran Slide model employs the two guides or rails for self-guided motion. The Ultra model is for unguided or externally guided applications. Both models employ end-of-stroke position sensing. The Ultran Slide model also employs midstroke position sensing. Various magnet configurations are available depending upon the load to be moved by the devices. Shock absorbers to decelerate the carried loads are also available.

Figure 3:
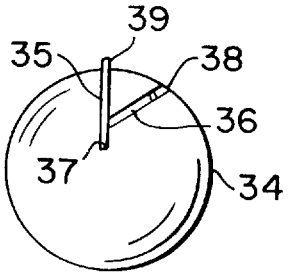
FIG. 3 is a cross section of the scoring device of FIG. 2.

A wear-resistant sphere 34 has a sharp scoring element in the form of a needle 35 held in place in a slot 37 by a set screw 36 in angled slot 38 as shown in FIG. 3. The needle 35 may include the diamond tip 39. Sphere 34 (FIG. 2) is mounted on double action air cylinder 40. Air inlet and outlet connect to system air actuator 23 (FIG. 1) for movement of the needle 35 up and down. Rodless air cylinder 40 provides for vertical movement of the needle 35 to engage the web 13 and "score" it for weakening purposes as well as vertical movement to "dampen" needle 35 movement as it moves across the moving web 13. Preferably, the weakening apparatus 19 is positioned close to a roller 12 as illustrated in FIG. 1 where there will be less undulation across the web 13.

Figure 4:
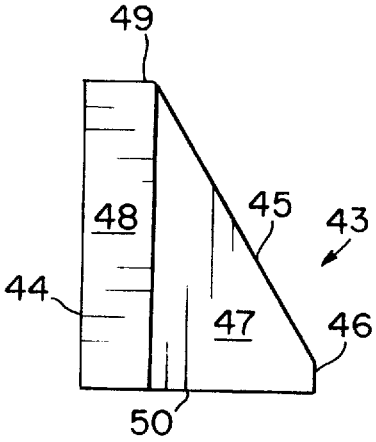
FIG. 4 is one embodiment of the attachment device used in FIG. 1.

FIG. 4 illustrates one embodiment of the adhesive flag 43 used to bind the web 13 to the empty spool 17. The flag 43 has first, second, and third edge portions 44, 45, 46 respectively and a forward edge 49 and trailing rearward edge 50. Adhesive coating 47 is designed to secure the flag 43 to the web 13. Adhesive coating 48 is designed to secure the flag 43 to the spool 17. As mentioned hereinabove, adhesive coating 48 is designed to accommodate the thickness of the adjacent web 13 either by being twice as thick as coating 47 or to be made of a compressible carrier with an elastomeric adhesive to provide no height variation across the flag when attached to the spool 17 and web 13. This design will minimize the possible tearing of the web 13 and other irregularities as it is wound.

Figure 5:
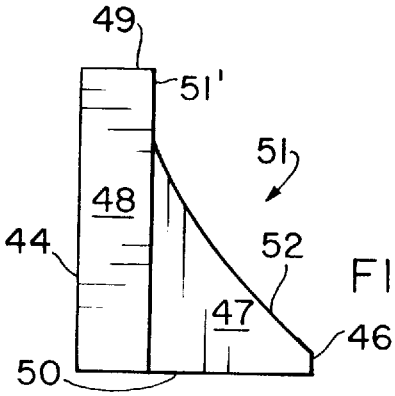
FIG. 5 is another embodiment of the attachment device used in FIG. 1.

Second edge 45 is illustrated as being straight. In FIG. 5, a similar flag 51 illustrates an arcuate edge 52 that provides for an arcuate tear across web 13 as will be further described hereinbelow.

Figure 6:
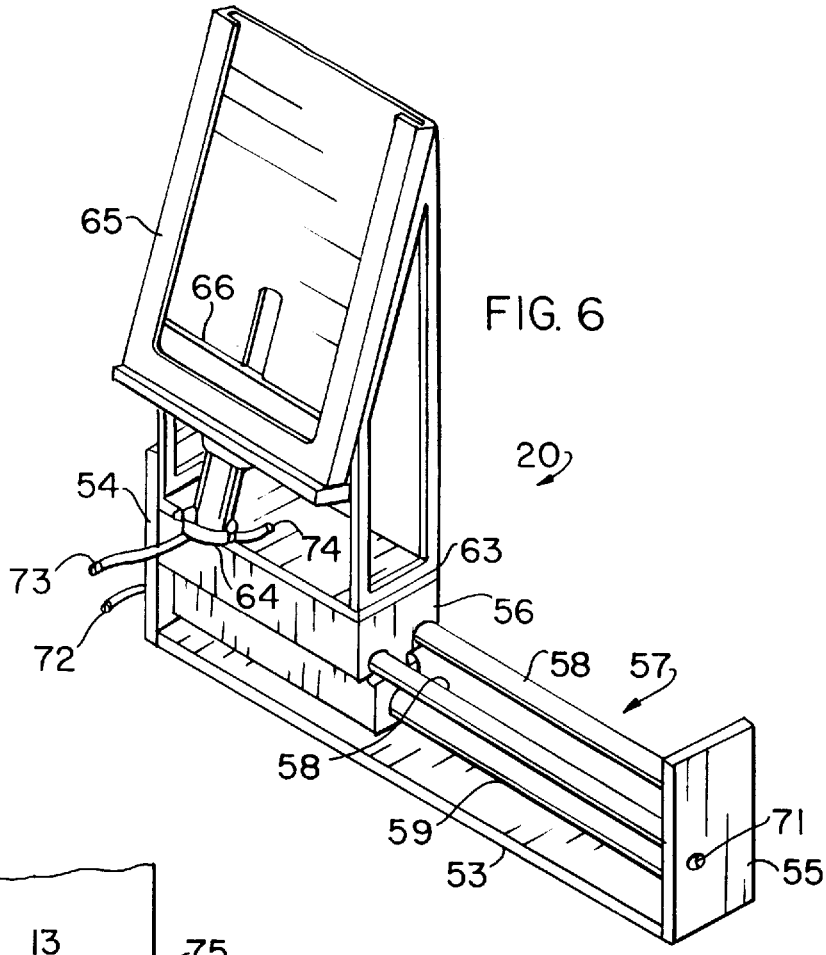
FIG. 6 is a perspective of the attachment apparatus of FIG. 1.

FIG. 6 illustrates the attachment apparatus 20 comprising a flag delivery system. Frame 53 has forward and rearward end portions 54 and 55 respectively that supports a rodless cylinder having a linear bearing carrier 56 that rides on a track 57 including two guides 58. Rodless air cylinder 59 has an inlet via actuator 22 and carries magnets that couple to the linear bearing carrier 56 when moved by air via actuator 22 (FIG. 1). The apparatus 20 also includes an upright frame 63 that is attached to carrier 56. Frame 63 includes a double action air cylinder 64 attached to flag feed tray 65 to operate flag feed slide 66. Slide 66 holds a flag 43 or 51 and is moved vertically via the action of cylinder 64 in response to signals from PLC 21. The length of travel of slide 66 depends on flag geometry and the layout of the various rollers 12, 14 that are used in the circumstances.

The air system for operating the weakening and attachment means 19 and 20 respectively is shown by air cylinder inlets 67 and 69 and outlets 68 and 70 in FIG. 2. In FIG. 6, air cylinder inlets 71 and 73 and outlets 72 and 74 are all well known in the art.

Figure 7:
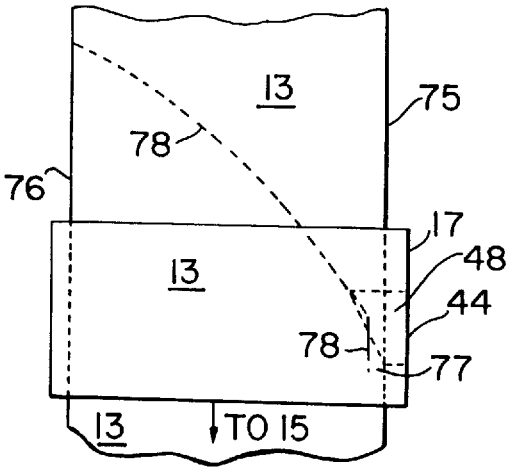
FIG. 7 is a top pictorial view of a scored web of paper prior to spool up.
Figure 8:
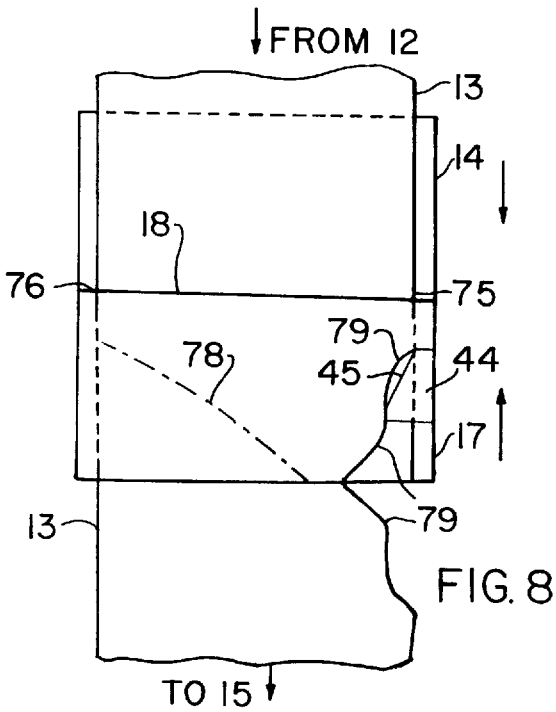
FIG. 8 is a top pictorial view of a web being torn according to the present invention.
Figure 9:
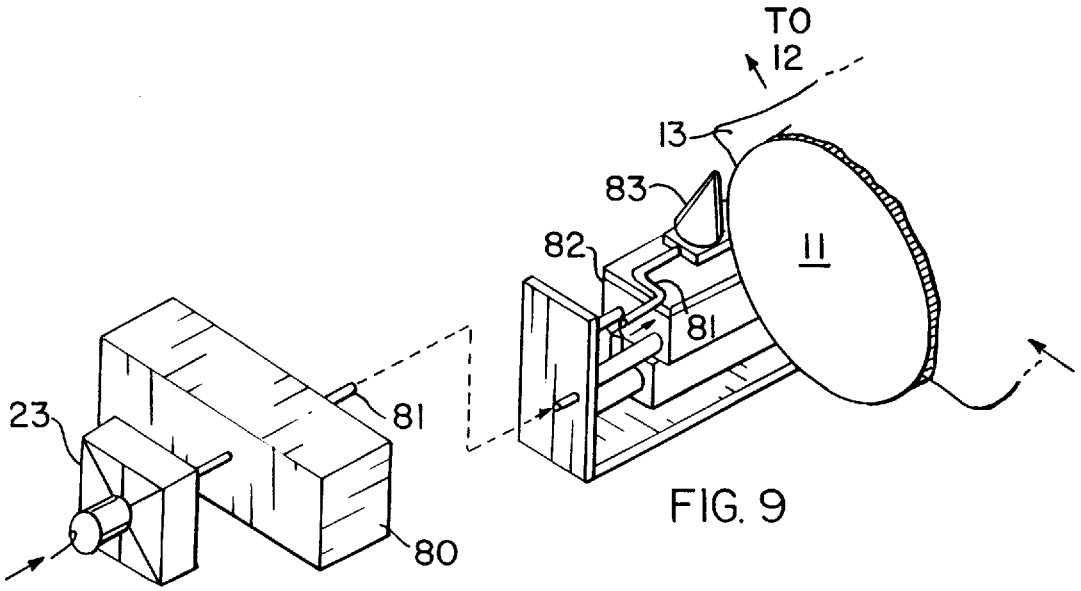
FIG. 9 is a partial perspective of another of the weakening apparatus of FIG. 1.

With regard now to FIGS. 7 and 8, the operation of the present invention can be discussed. FIG. 7 illustrates, via exaggerated dimensions for clarity, the web 13 attached to the underside of spool 17. The web 13 has opposite edges 75, 76. The weakening means 19 has created a "score" line 78 from a point adjacent edge 75 and extending across the web 13 to the opposite edge 76. As the spool 17 is turned the vertical movement of web 13 places sufficient shear force on the score line 78 to cause a tear line 79 (FIG. 8). The portion of the web 13 shown at numeral 77 in FIG. 7 is the area where the controlled tearing originates. The path of the tear line 79 is heavily influenced by the geometry of the flag 43, especially the edge 45 (or 52), and the score line 78. Ideally, the tear line 79 will follow score line 78 but in practice there may be some deviation depending upon the means used to create the score line and other factors such as the flag geometry and the type of paper comprising web 13. Accordingly, the tear line 79 will substantially follow the score line 78 and will in some cases intercept the score line 78 at a point along its length even if the tear line 79 did not follow the line 79 from the origin near portion 77. With regard now to FIG. 9, an alternate embodiment of the weakening apparatus in accord with the present invention is illustrated. The guided rodless cylinder 82 carries a nozzle 83 that receives a particulate and air mixture from the air/particulate mixing venturi tank 80 via hose 81. Valve 23 provides air from the plant air system. The specific air connections to the cylinder 82 are standard fittings as understood in the art and are not shown for simplicity in the drawings. The material used as particulate may be selected from any appropriate material, for example, starch and other appropriate in the installations environment. In addition, water may be used.

Figure 10:
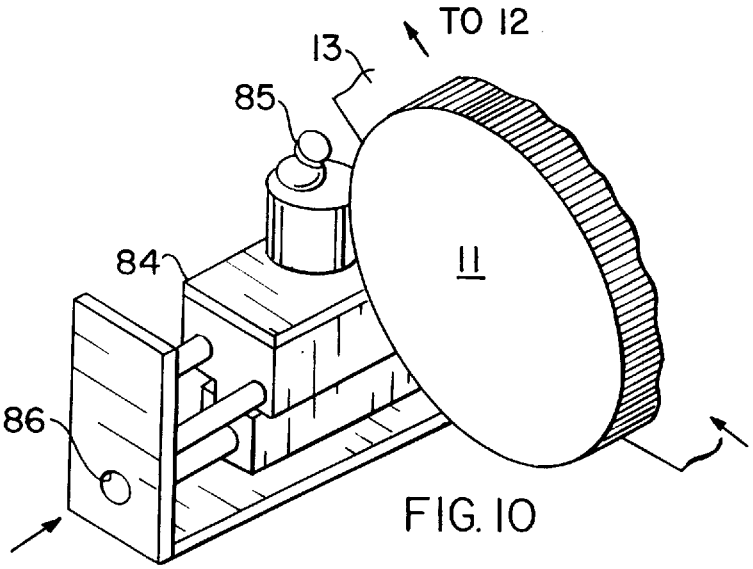
FIG. 10 is a partial perspective of another weakening apparatus of FIG. 1.

FIG. 10 illustrates the use of a laser 85 as a weakening means 19. The laser 85 is mounted on a standard guided rodless cylinder 84 having an inlet from the plant air system and includes the standard electrical connections (not shown) as understood in the art.

Figure 11:
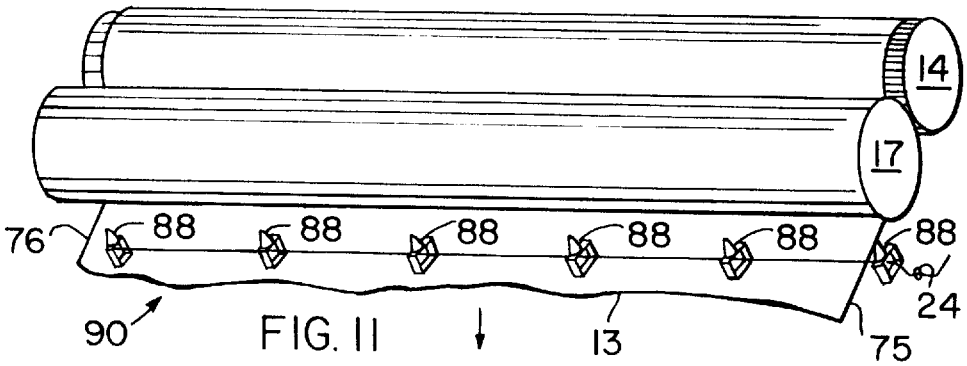
FIG. 11 is a perspective view of an optional air vectoring apparatus used in the present invention.
Figure 12:
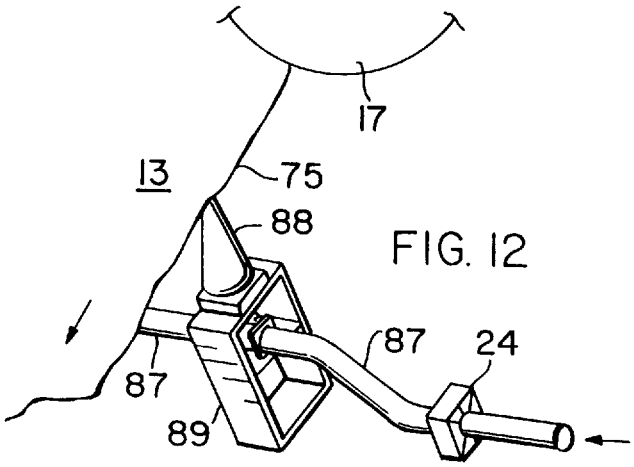
FIG. 12 is an enlarged view of one air nozzle of FIG. 11.
Figure 13:
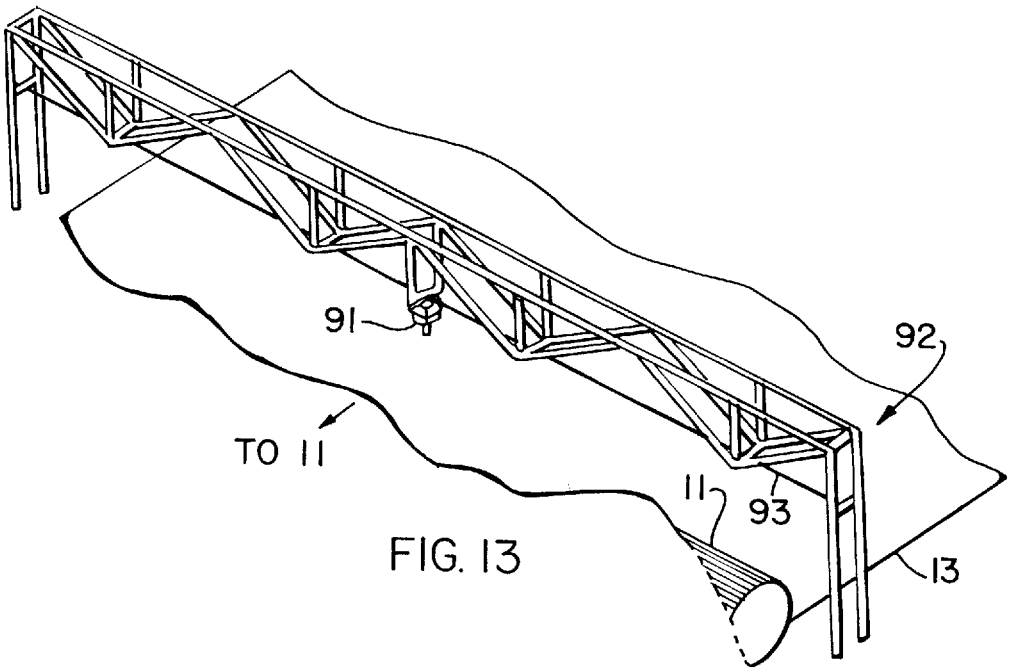
FIG. 13 is a perspective of another weakening apparatus in an alternative position to the placement of FIG. 1.

FIGS. 11 and 12 illustrate the vectored air assist for web turnup. Air line 87 from vectored air control valve 24 supplies high pressure air to six nozzles 88 mounted on respective support brackets 89. The six nozzles form a nozzle bank 90 that pushes the web 13 vertically with one nozzle 88 being at web first edge 75 to assist in turnup and the controlled tear of the web 13 as it is spooled onto spool 17. FIG. 13 illustrates another embodiment of the weakening means 19 that is positioned on the incoming side of roller 11 instead of near roller 12 as in the other embodiments. Oscillating laser 91 is mounted on a frame support assembly 92 via a shaft 93. This weakening means 19 is placed upstream of roller 11 to provide a relatively flat surface of web 13 for proper weakening as the laser 91 sweeps across the web.

The specific technology used as the weakening means 19 will ultimately depend on the ease of tearing the type of paper involved as well as web speed and flag geometry to achieve the best results in the circumstances.

Figure 14:
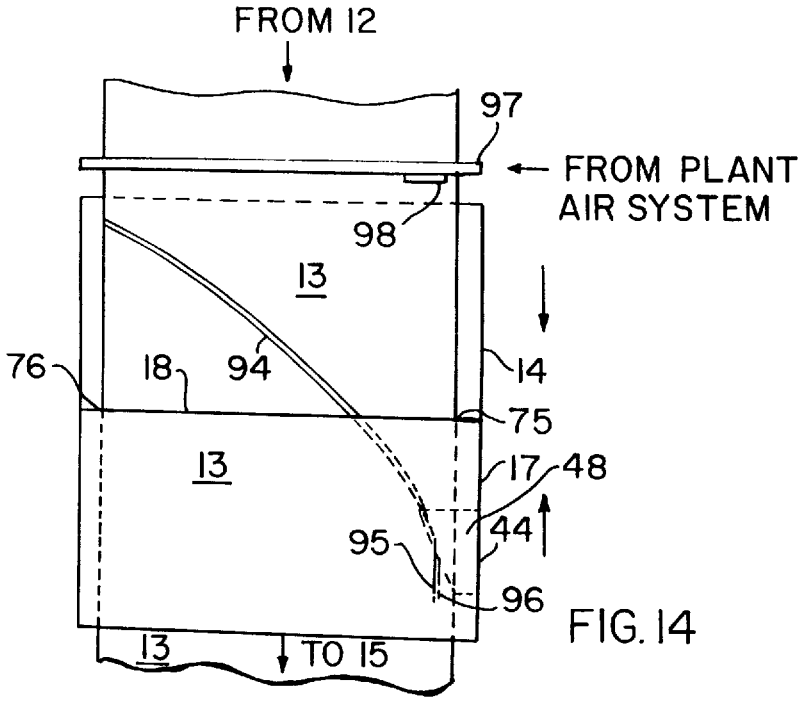
FIGS. 14 and 15 are perspectives of a method of applying a thin and narrow spray of adhesive across the web.
Figure 15:
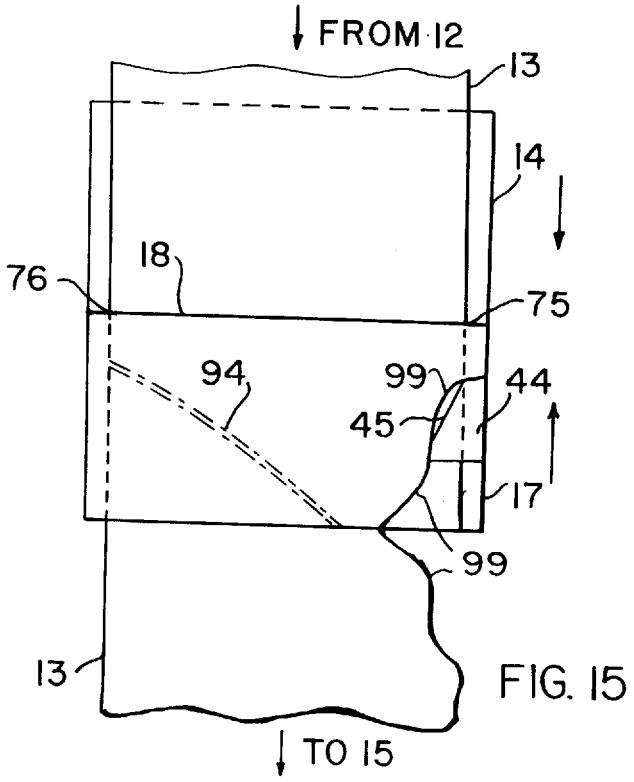

FIGS. 14 and 15 illustrates another method of creating a shear force line for the controlled tearing of the web. The physical dimensions of the apparatus are exaggerated for purposes of illustration. Spray glue line 94 is placed on top of the web 13 as it travels over spool 14. Glue line 94 may be water-soluble or non-soluble pressure sensitive adhesive and originates at line 95 to define a start portion 96 adjacent edge 75. The flag 43 or 51 is used as before. Glue nozzle 98 is carried by guided rodless cylinder 97 controlled PLC 21 and plant air that is substantially identical to the cylinder to the cylinders herein above described. Tear line 99 is created by the shear forces on the glue line 94 as line 94 attaches to the surface of spool 17.

The tear line 99 is shown to be substantially the same in FIG. 15 as in FIG. 8, but it is to be understood that the respective tear lines may not follow the shear force line exactly depending upon the type of material forming the web 13. The use of a water soluble adhesive for the line 94 will provide for weakening of the web 13 and therefore a more predictable tear line 99.

In all embodiments it is preferred to have the shear force line, however created, extend substantially the entire width of web 13. It is to be understood that the various shear lines could terminate before the edge opposite their origin and still provide for a satisfactory shear line depending upon the web type, installation geometry and machine dynamics.

Figure 16:
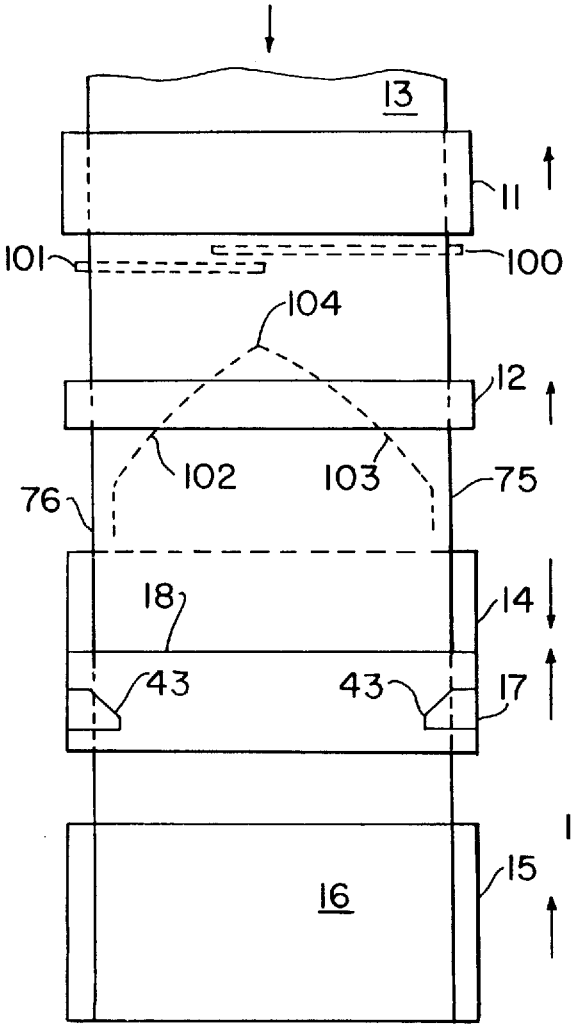
FIG. 16 is a top view of the machine apparatus of FIG. 1 illustrating one method of creating two score lines in the web.

The discussion hereinabove has been directed toward the creation of a single tear line. In some applications however, particularly in very wide web and spool widths, it may be preferable to generate two tear lines—each of which originate near a respective edge 75 and 76 of the web 13. In FIG. 16, scoring needle cylinder carriers 100 and 101 are mounted to create score lines 102 and 103 respectively and illustrated in that order of occurrence. The score lines 102 and 103 extend to the middle, and converge at point 104 or may continue and overlap depending upon the length of the carriers and the program of PLC 21. Twin flags 43 (or 51) are used for two points of attachment of the web to empty spool 17 and tear proceeds as described above.

Figure 17:
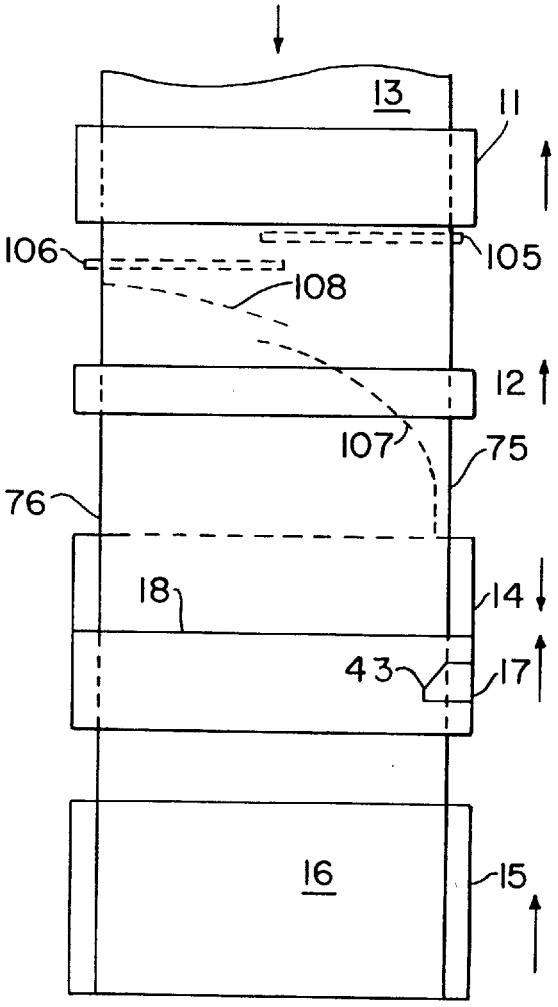
FIG. 17 is a top view of the machine apparatus of FIG. 1 illustrating the creation of staggered score lines in the web.

FIG. 17 illustrates the creation of two staggered score lines 107 and 108 by two staggered scoring devices 105 and 106. Tearing along the first score line 107 will proceed across the web 13 to score line 108. Tearing proceeds to the other edge 76 of the web 13.

Figure 18:
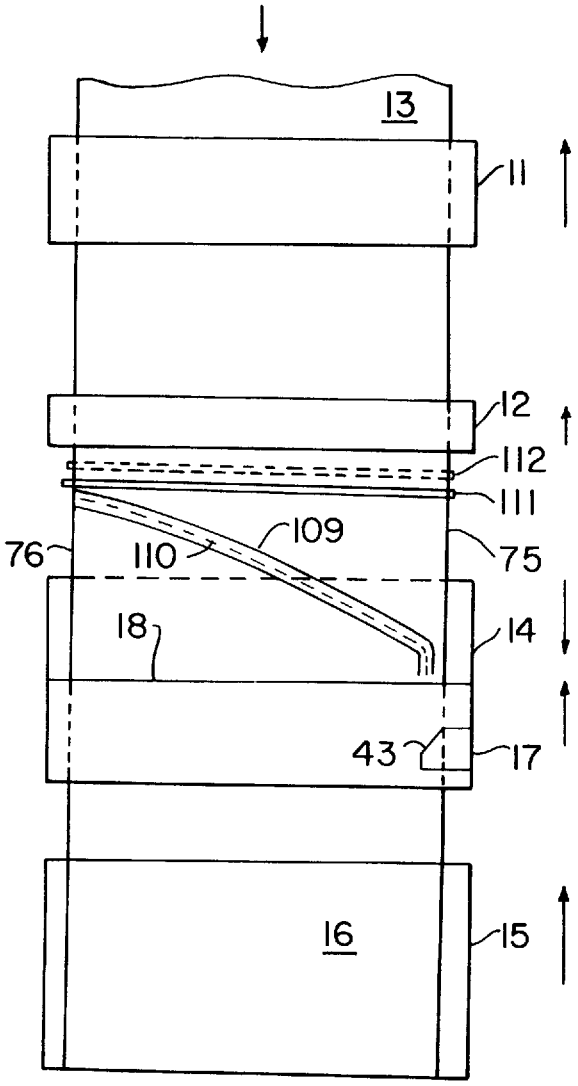
FIG. 18 is a top view of the machine apparatus illustrating the creation of a score line below and an adhesive layer above the web.

FIG. 18 illustrates the creation of a score line 110 on the underside of web 13 via scoring device 112. An elongate adhesive band 109 is placed on top of the web via adhesive nozzle carrying track device 111. This particular arrangement can be used with or without water soluble adhesive to cause tearing in the web material. Some of the adhesive band 109 forward of score line 110 may be transferred to the empty spool 17, but some remains on such torn edge to cause attachment of the web 13 to the full rolled web 16 on spool 15 thereby securing the torn end of the web to the roll. The adhesive band 109 rearward of the score line 110 will assure proper attachment of web 13 to empty spool 17.

Figure 19:
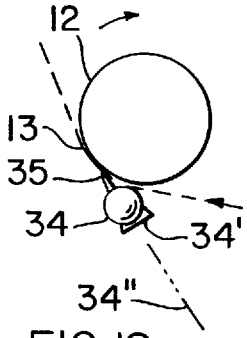
FIG. 19 is a pictorial view of an alternative method of creating a score line.

FIG. 19 illustrates in pictorial form an alternative arrangement of the scoring needle 35. In this embodiment of the invention the idler roller 12 may function as an anvil or backing to provide for a more uniform and/or deeper score line that may be needed on heavier paper. The ball 34 is rotatably mounted by bearing 34' so that it may rotate about axis 34" due to web engagement.

Figure 20:
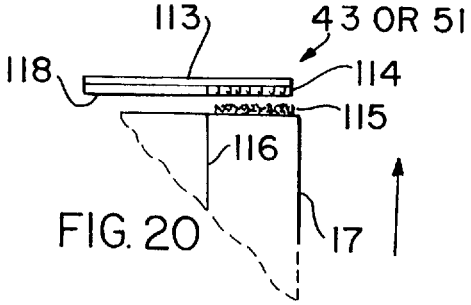
FIG. 20 is a pictorial view illustrating the use of mating releasable fasteners to attach the web to a spool.

FIG. 20 illustrates the use of mating releasable fasteners, such as the well known trademarked product Velcro for flag attachment. The flag 43 or 51 includes a hook type portion 114 of the Velcro for attaching to the fluff or pad portion 115 that is preattached to a spool 17 near the edge thereof outwardly of the trim line 116 that marks the lateral extent of the web 13. Adhesive portion 113 of the flag 43 or 51 is attached to the web 13 from below as described hereinabove. Fastener portions 114 and 115 will engage in the nip 18 to cause an effective turn up. Preferably, the fluff or pad portion 115 is placed on the spool 15 and 17, which are used repeatedly after further processing of rolled web 16. Thus, the expendable flag 43 or 51 contains the new hook portion each time it is used assuring attachment to the spool 17 via its fluff portion 114.

Finally, it is important to consider that the weakened lines to which shear force is applied can be created on top of the web 13 using any of the devices and methods herein described if sufficient clearances exist above the papermaking machinery. The method preferred in a given application will also depend on the specific material of the web 13 along with machine dynamics and other well known factors.

Figure 21:
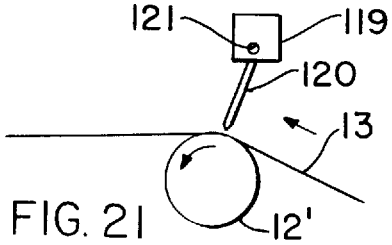
FIG. 21 is a pictorial view illustrating the use of a fluid-loaded scoring device.

FIG. 21 illustrates a lead roller 12' positioned with the web 13 travelling above it. Cylinder carrier 119 supports a fluid-loaded application device 120 that is similar to a ballpoint pen in operation. Fluid intake 121 receives a water based or other viscous fluid such as an appropriate acid that will weaken the web 13 along a score line created by contact with device 120. The fluid supplied by device 120 will be sufficient to weaken heavier web medias, such as specialty paper and the like.

Figure 22:
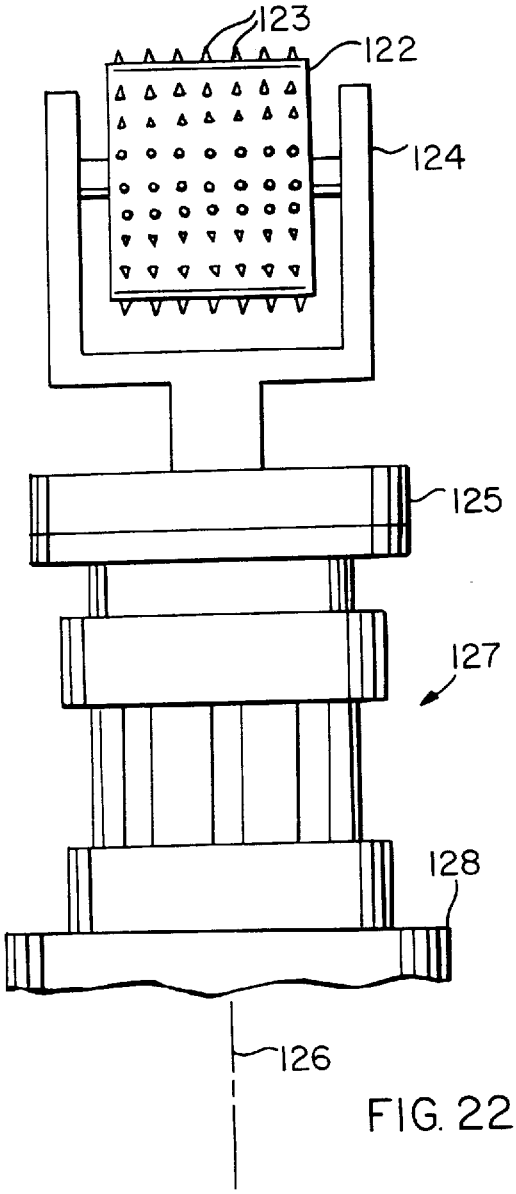
FIG. 22 is a pictorial diagram of a rotating perforating member for weakening the web.

FIG. 22 illustrates another weakening means 19 in the form of a rotating member 122 for perforating the web 13. Member 122 may carry a plurality of rows of sharp elements or teeth 123 on the perimeter thereof. The member 122 is horizontally rotatably mounted on a yoke 124 via thrust bearing 125 which is rotatable about the yoke's vertical axis 126. Preferably member 122 is biased upwardly via a non-rotating pneumatic damper 127 to accommodate undulations in the travelling web 13. The yoke 124 is carried across the web 13 by carrier cylinder 128, in a manner previously described in FIG. 2.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A method of transferring a web thin material from a first spool to a second spool including the steps of:

A. providing an elongate portion of the web to which shear force can be applied beginning adjacent to and extending parallel with one edge of the web to define a start portion and which then extends substantially non-perpendicular to side edges of the web and substantially across the width of the web to adjacent the opposite edge;

B. affixing the start portion of the web to the second spool; and

C. winding the web onto the second spool in a manner to provide shear force along the elongate portion formed in step A to cause severing of the web generally along the elongate portion to sever the web entirely between its edges.

2. The method of claim 1 wherein step A includes the step of:

D. applying a layer of pressure-sensitive adhesive to the web along the elongate portion for attaching the web to the second spool with the adhesive layer.

3. The method of claim 2 wherein step D includes the step of:

E. applying an initial portion of the layer of adhesive in a direction substantially parallel to the one edge of the web.

4. The method of claim 2 wherein step D includes the step of:

E. applying a water soluble glue to structurally weaken the web along the elongate portion.

5. The method of claim 1 wherein step A includes the step of:

D. providing the elongate portion to extend from the start portion to the opposite edge of the web.

6. The method of claim 1 wherein step A includes the step of:

D. structurally weakening the web along a narrow line starting from adjacent one edge and extending substantially across the web.

7. The method of claim 6 wherein step D includes the step of:

E. employing a movable weakening means to provide a single substantially continuous line across the web.

8. The method of claim 6 wherein step A includes the step of:

E. scoring the web with a sharp element.

9. The method of claim 8 wherein step A includes the step of:

E. employing a movable scoring means to provide a single substantially continuous scoring of the web.

10. The method of claim 6 wherein step A includes the step of:

E. scoring the web with a sharp element from one planar side with an anvil on the other planar side.

11. The method of claim 1 wherein step B includes the step of:

D. affixing one portion of an adhesive tape to the start portion of the web and another portion of the tape to the second spool.

12. A method of transferring a web thin material from a first spool to a second spool including the steps of:

A. providing a narrow elongate portion of the web to which shear force can be applied to cause severing of the web along the portion beginning adjacent to and extending parallel with one edge of the web to define a start portion and extending substantially non-perpendicularly to the edges of the web and substantially across the width of the web to adjacent the opposite edge;

B. attaching the start portion of the web to the second spool; and

C. applying a shear force along the portion created in step A to sever the web generally along the elongate portion.

13. The method of claim 12 wherein step A includes the step of:

D. scoring the web with a sharp element to structurally weaken the web along the elongate portion.

14. The method of claim 12 wherein step A includes the step of:

D. spraying a thin stream of water onto the web to structurally weaken the web along the elongate portion.

15. The method of claim 12 wherein step A includes the step of:

D. spraying a thin stream of air and particulate at the web to structurally weaken the web along the elongate portion.

16. The method of claim 12 wherein step A includes the step of:

D. applying a narrow and thin layer of adhesive to the web to attach the web to the second spool along the elongate portion.

17. The method of claim 16 wherein step D includes the step of:

E. applying water soluble adhesive to structurally weaken the web along the elongate portion.

18. The method of claim 12 wherein step A includes the step of:

D. passing a laser beam capable of structurally weakening the web across the web to weaken the web along the elongate portion.

19. The method of claim 18 wherein step D includes the step of:

E. moving the laser emitting the laser beam across the web.

20. The method of claim 19 wherein step D includes the step of:

E. moving the laser beam across the web without traversing the web with the laser.

21. The method of claim 12 wherein step B includes the step of:

D. attaching one mateable releasable fastener to the empty spool and another mateable releasable fastener to the web in a manner to provide for mating of the fasteners to attach the web to the empty spool.

22. The method of claim 12 wherein step A includes the steps of:

D. applying to the web a viscous fluid by a traversely moving element in contact with the web on one planar side thereof to structurally weaken the web; and E. providing an anvil in contact with the other planar side of the web generally opposite to the element.

23. The method of claim 12 wherein step A further includes the step of:

D. weakening the web along the elongate portion; and

E. applying a narrow and thin layer of adhesive to the web superimposed along the elongate portion.

24. The method of claim 12 wherein step A includes the step of:

D. perforating the web with a rotating member carrying a plurality of sharp elements to structurally weaken the web along the elongate portion.

25. A method of transferring a web of thin material from a first spool to a second spool including the steps of:

A. providing two elongate portions of the web to which shear force can be applied to cause severing of the web along each portion beginning adjacent each edge of the web to define respective start portions, each elongate portion extending across a substantial portion of the width of the web and terminating generally adjacent the middle of the web;

B. attaching each respective start portion of the web to the second spool; and

C. applying a shear force along the portions of created in step A to sever the web generally along the elongate portions to sever the web entirely between its edges.

26. A method of transferring a web of thin material from a first spool to a second spool including the steps of:

A. providing a first and second elongate portion of the web to which shear force can be applied to cause severing of the web along each portion, the first elongate portion beginning adjacent one edge of the web to define a start portion and terminating in an end generally medially of the web, the second elongate portion beginning generally medially of the web and adjacent the end of the first portion and extending across the web to adjacent the other edge;

B. attaching the start portion of the web to the second spool; and

C. applying a shear force along the first and second elongate portions created in step A to sever the web generally along the elongate portions entirely between its edges.

* * * * *